US007025527B2

(12) United States Patent
Mecham

(10) Patent No.: US 7,025,527 B2
(45) Date of Patent: Apr. 11, 2006

(54) HIGHWAY MARKER

(76) Inventor: Lynn Mecham, 546 W. 800 South, Alpine, UT (US) 84004

( * ) Notice: Subject to any disclaimer, the term of this patent is extended or adjusted under 35 U.S.C. 154(b) by 0 days.

(21) Appl. No.: 10/922,310

(22) Filed: Aug. 20, 2004

(65) Prior Publication Data

US 2006/0039751 A1 Feb. 23, 2006

(51) Int. Cl.
*E01F 9/07* (2006.01)

(52) U.S. Cl. ..... 404/12; 404/10; 404/14

(58) Field of Classification Search ..... 404/12–16, 404/10

See application file for complete search history.

(56) References Cited

U.S. PATENT DOCUMENTS 1,777,585 A * 10/1930 Springer ..... 404/11
3,257,552 A * 6/1966 Converso ..... 362/390
3,292,506 A * 12/1966 Kone ..... 404/11
4,595,312 A * 6/1986 Corless ..... 404/11
4,597,691 A * 7/1986 Clarke ..... 404/11
4,737,049 A * 4/1988 Callhan ..... 359/551
5,302,048 A * 4/1994 Paulos et al. ..... 404/11

* cited by examiner

*Primary Examiner*—Raymond W Addie
(74) *Attorney, Agent, or Firm*—M. Reid Russell

(57) ABSTRACT

A highway marker for implantation in a highway or roadway where a top surface of the marker is just above the roadway surface and is centered in a stripe that separates the lane or roadway from the lane or roadway shoulder. The highway marker includes an outer sleeve formed from a section of five inch steel pipe that is for installation in the road with its top edge level with the road surface and contains a steel core centered in the sleeve in rubber that extends to the inner surface of the outer sleeve, the bonded rubber tending to deflect downwardly and rebound when a force is applied onto the steel core. The steel core is center tapped to receive a bolt that is fitted through a disk shaped cap having equal spaced sloping radial ribs that extend from a raised collar to the cap edge whereby, a weight of a vehicle tire traveling up a rib will depress the cap and steel core downwardly that rebounds after passage of the vehicle tire, and which cap can be colored as with a reflective surface over one hemisphere and red over the other for warning a driver of danger.

5 Claims, 4 Drawing Sheets

HIGHWAY MARKER

BACKGROUND OF THE INVENTION

1. Field of the Invention

The present invention pertains to highway and/or roadside markers separating the side of a traffic lane from the roadway shoulder, preferably providing a reflective surface on the lane line indicating the lane edge and a raised area that a driver senses as a bump should a vehicle travel to the edge, alerting the driver before his wheel travels onto the roadway shoulder.

2. Prior Art

Highway and roadside lane markers are, of course, well known, and often include, as does the invention, a surface that can be reflective to alert drivers to the edge of the road or lane, and are often raised to alert a driver as their tire is slightly lifted and bumps over the marker that there are about to drive into the shoulder. Such earlier markers have provided for driver safety by exerting a slight force on the steering wheel as a tire passes thereover, causing the driver to become more alert and even waking the driver should they have fallen asleep. Such earlier markers, however, have presented a major problem for snow plows clearing the highway or road of snow as they are not readily seen by the plow operator when the highway or road is covered with snow and, should the plow blade end strike and even gouge into the marker, the plow blade will be deflected upwardly against a hydraulic assembly that is set to maintain the plow blade in a desired plane slightly above the roadway. Such deflection can damage a hydraulic ram and connecting linkages to the blade. Prior to the invention, highway markers have not been capable, as is the present invention, to displace, an upper portion moving into a mounting sleeve, to allow a plow blade impacting thereagainst to slide smoothly, without damage, over the highway marker.

SUMMARY OF THE INVENTION

The invention is in a highway roadside marker for marking the outer edge of a highway or road to afford a vehicle driver with a visual reference of the road edge, and to provide for a deflection or slight bounce to a vehicle tire passing thereover should a vehicle stray towards the highway or road shoulder. Which marker, however, when rolled over or struck by a snow plow blade will tend to depress, dampening the impact on the tire and/or allowing the snow plow blade to pass thereover without upward deflection as could damage that snow plow blade hydraulic blade suspension system.

The highway marker of the invention includes a cylindrical section, that is preferably a five inch steel pipe, and is cut into a short cylinder for burial in the side of the highway or road to a depth where the upper edge is essentially flush with the highway or road surface. A steel core having a center threaded hole formed therethrough is itself centered in the short cylinder and a bonding rubber is hot poured therearound leaving a void below the steel core and above the short cylinder lower edge. The bonding rubber cools and bonds to the walls of both the short cylinder and steel core, suspending the steel core therein with the rubber functioning as a disk spring and allowing the steel core to flex downwardly when a weight is applied to the top of the short cylinder, and return to its original attitude when the weight is removed. The steel core is to receive a cap, that is preferably a metal casting, but may be manufactured from nylon or plastic, as can the cap, and includes a center opening formed therethrough that is preferably threaded along its lower section. A bolt is fitted through the cap top and is turned in the steel core threaded center hole, mounting the cap onto the steel core. The cap includes spaced radial ribs that slope upwardly to a cap neck from an outer edge of a flat plate. Which cap neck has the center hole formed therethrough. In practice, the cap is divided into hemispheres as by painting the one hemisphere one color, such as with a reflective paint, and the other hemisphere another color, such as with red paint for indicating danger, such as wrong direction. Thereby, by loosening the bolt that secures the cap onto the steel core, the cap can to turned to where the one hemisphere or the other extends into the roadway or lane, such as the reflective paint hemisphere, and the other hemisphere indicates, as with the red surface the edge of the highway or road.

When, during plowing of snow off of the highway or outer lane, a snow plow blade slides against the highway marker, the blade is directed up the sloping ribs, across the steel, rayon or nylon core and down the sloping ribs. In which travel the weight of the blade depresses the steel core into the cylindrical sleeve with, after passage of the plow blade off of the highway marker, the bonding rubber functioning as a disk spring, unloads and returns the cylindrical sleeve and mounted cap back to their original attitude.

It is a principal object of the present invention to provide a highway marker that will depress to where it is essentially flush with a highway or roadway surface when struck by a snow plow blade, or vehicle tire, and then return back to its original attitude after the snow plow blade or tire has passed thereover.

Another object of the present invention is to provide a combination of a short steel, rayon or nylon cylinder for installation into a highway lane or roadway centered on an inner lane of road edge, and adjacent to a shoulder, to where the cylinder top edge is essentially flush with the lane or roadway surface, and which steel cylinder receives a steel core having a center opening that is centered in the cylinder, with the steel, or other material, core to receive a flow of hot bonding rubber therearound, suspending the steel core to leave a void from the bottom surface of the steel core to a lower edge of the steel cylinder providing a capability for the steel core to flex into the steel cylinder and return to its original attitude when subjected to a shock, such as a snow plow blade passing thereover.

Another object of the present invention is to provide for releasably mounting a cap onto the steel core having upwards sloping equal spaced radial ribs extending from a plate edge to a cap neck and projecting above the steel cylinder.

Still another object of the present invention is to provide a bolt arrangement for turning through an opening formed through the cap and into a threaded opening in the steel core that, when loosed, allows the cap to be turned.

Still another object or the present invention is to provide for differently painting or coloring the hemispheres of the cap as, for example, with a reflective paint on one hemisphere and red, indicating danger such as wrong direction, on the other hemisphere for alerting a drivers of a vehicle approaching the highway marker of the presence of the highway or road edge and shoulder.

BRIEF DESCRIPTION OF THE DRAWINGS

These and other objects and features of the present invention will become more apparent from the following description in which the invention is described in detail in conjunction with the accompanying drawings.

DETAILED DESCRIPTION

Figure 1:
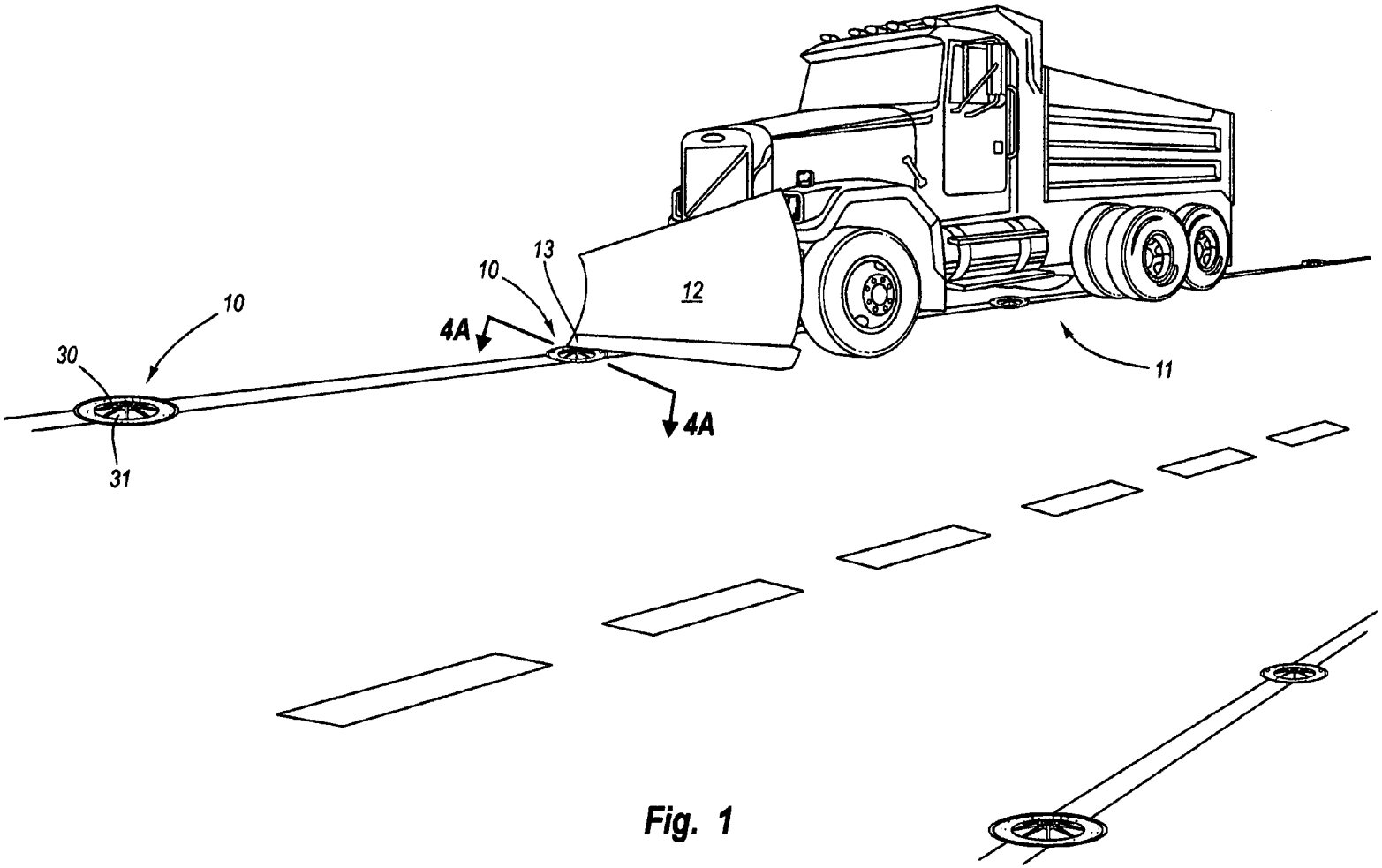
FIG. 1 is a forward elevation perspective view taken from a driver side of a highway snow plow showing the plow blade end riding on the outside line of a two lane road, with the blade end in contact and depressing a highway marker of the invention.

The invention, as is hereinafter described, relates to highway markers for installation between each traffic lane and shoulder, usually on line with a lane edge stripe. The highway marker 10, of the invention, is shown in FIG. 1 installed into the road surface, and as an enlarged perspective view in FIG. 2. The highway marker 10 is sunk into the roadway to where the highway marker 10, at its top outer circumference 14*a*, is in the same plane as, and is centered in each lane stripe, and can be included with center line striping, not shown, within the scope of this disclosure. The lane line marking can be a continuous stripe, or broken center line stripes, as shown in FIG. 1. FIG. 1 also shows a snow plow 11 whereon is mounted a snow plow blade 12 whose passenger side corner 13 is shown as having engaged one of the highway markers 10. Heretofore, when a plow blade has engaged a highway marker that is rigid and does not deflect downwardly responsive to contact with a snow plow blade corner, the snow plow blade will be deflected upwardly, and that deflection may and often does damage a hydraulic assembly as maintains the plow blade at a plowing position. The highway marker 10 of the invention, as set out and described hereinbelow, when so struck is arranged to retract downwardly into the short cylindrical housing, allowing the blade 12 to slide over the marker without damage.

Figure 2:
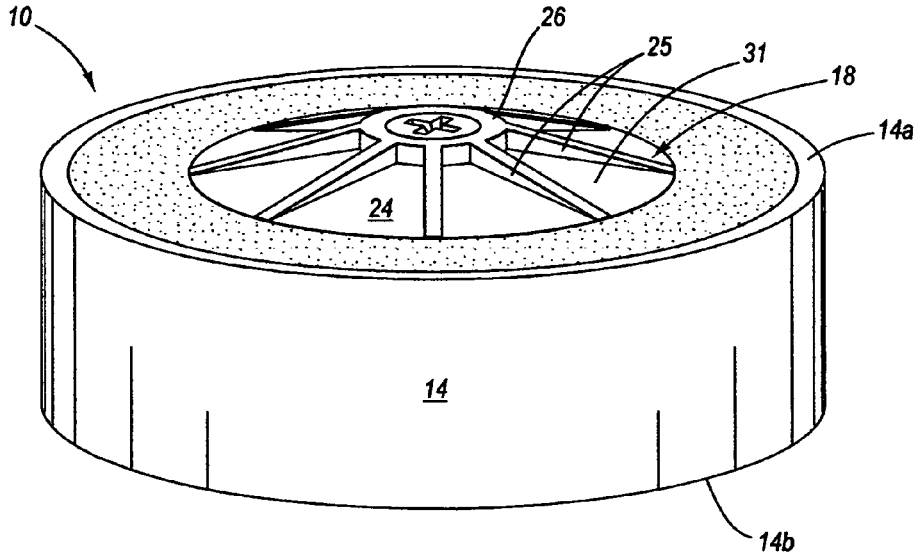
FIG. 2 shows an enlarged side elevation perspective view taken from the side and slightly above the highway marker of FIG. 1 that has been removed from the road.
Figure 3:
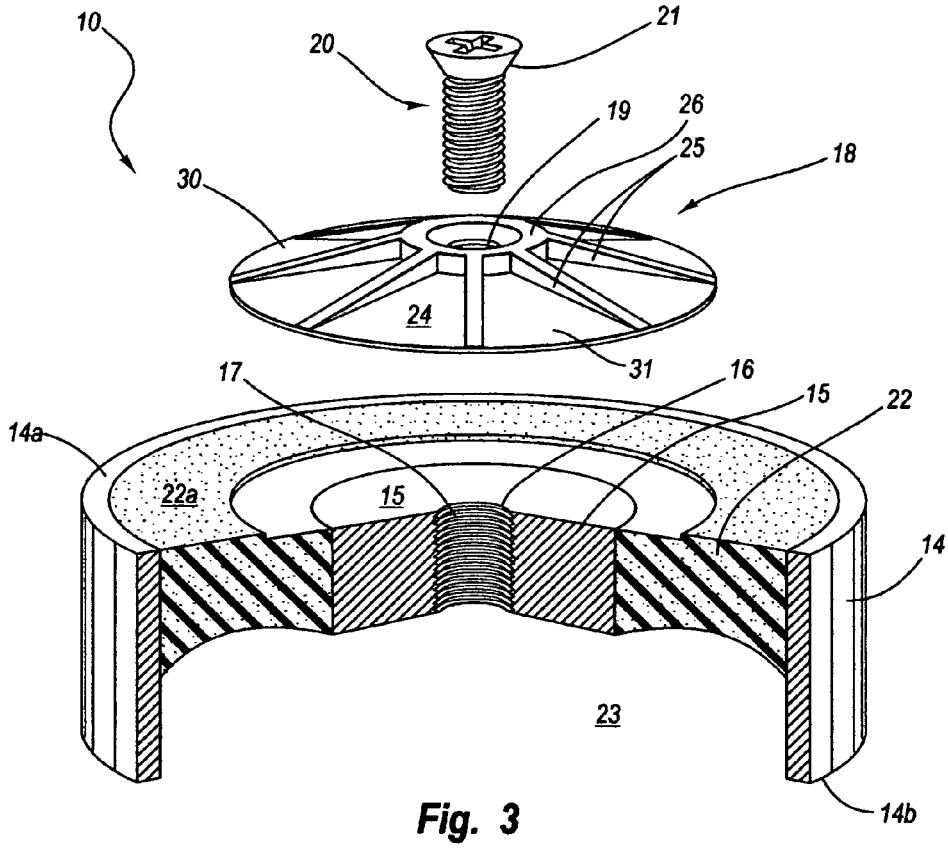
FIG. 3 shows a side elevation perspective view of the highway marker of FIG. 2 wherefrom a section has been removed, exposing the components of the invention that have been exploded apart.
Figure 4A:
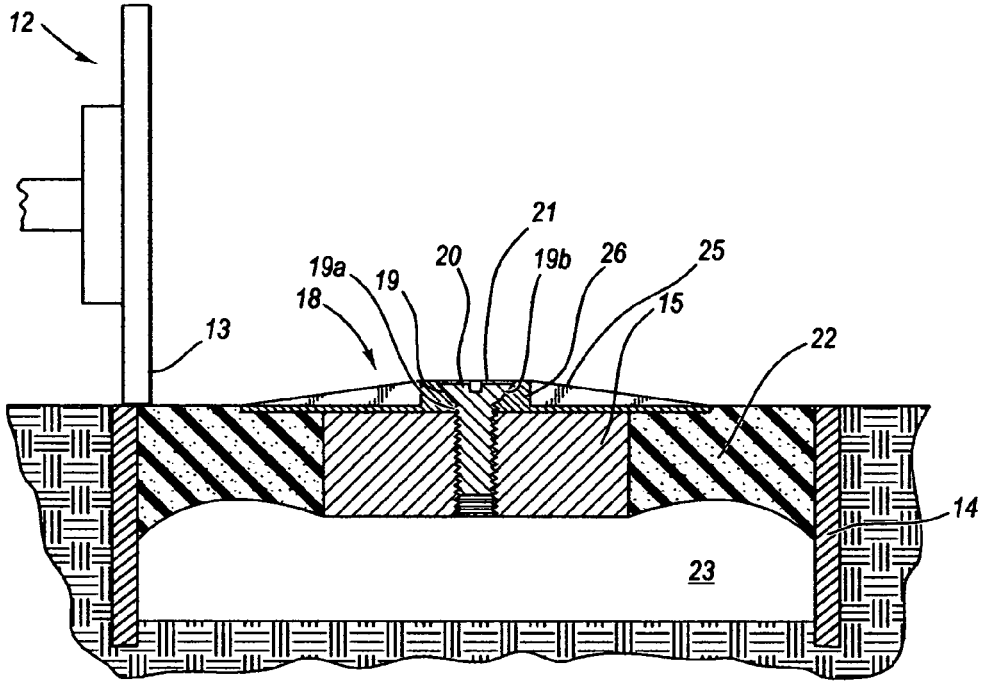
FIG. 4A shows a sectional view taken along the line 4A—4A of FIG. 1 showing the snow plow blade first contacting the highway marker steel cylinder top edge.
Figure 4B:
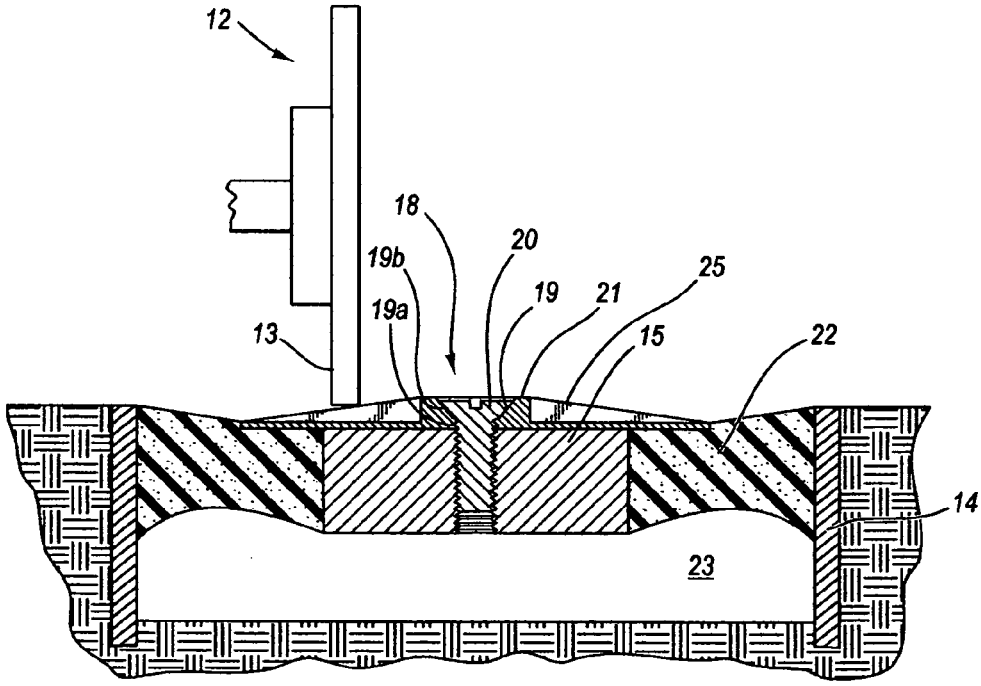
FIG. 4B shows the snow plow blade of FIG. 4A as having traveled across a rubber portion and onto the cap portion of the highway marker, proceeding up a rib or ribs of the cap, depressing the cap and a connected steel core whereto the cap is connected, with the steel core contained in the rubber portion.
Figure 4C:
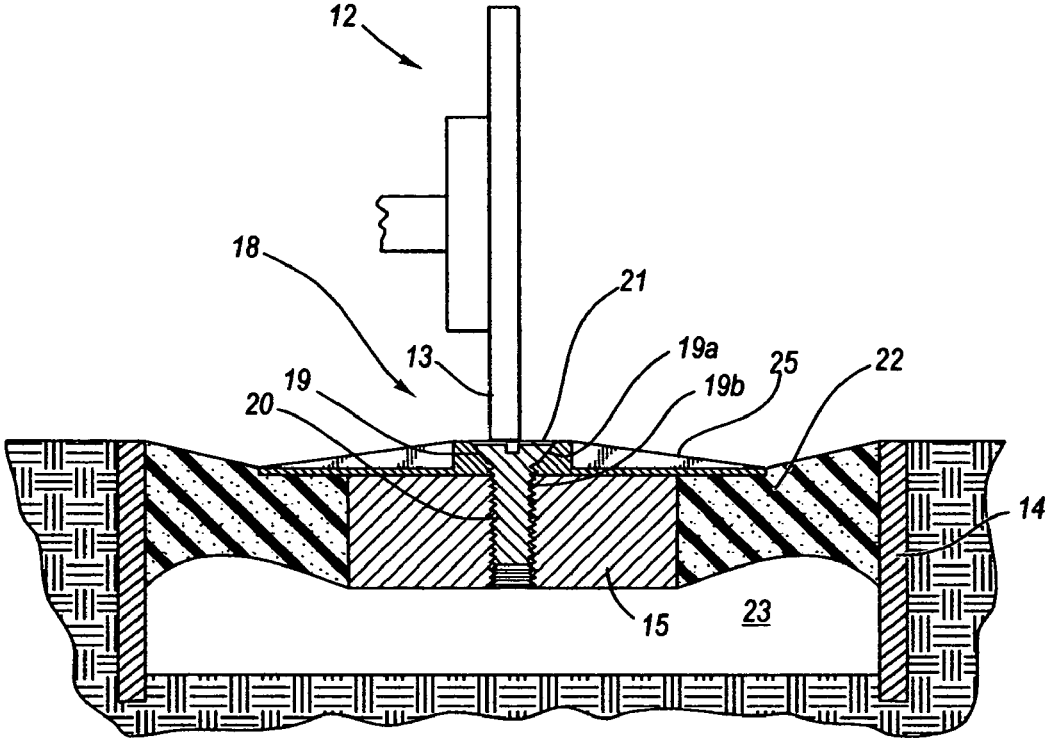
FIG. 4C shows the snow plow blade of FIGS. 4A and 4B as having traveled onto the apex of the cap, fully depressing the cap and steel core into the rubber portion.

FIG. 2 shows an enlarged perspective view of the highway marker 10 removed from the roadway of FIG. 1. Shown best in the exploded sectional view of FIG. 3, the highway marker 10 includes: an outer sleeve 14 that is preferably formed from a cylindrical section of five inch diameter steel pipe, but may be formed from nylon or plastic; a short cylindrical core 15 that is preferably formed from steel but may be nylon or plastic, and has a center opening 16 that is threaded at 17; and a cap 18 that may be formed from steel, nylon or plastic, and has a center opening 19 that, as shown in FIGS. 4A, 4B and 4C, may be threaded at a lower end 19*a*, and is counter sunk at a top end 19*b*. Which cap 18, as shown in FIGS. 3, 4A, 4B and 4C, receives a sloping end 21 of a threaded bolt 20 turned through the cap threaded end 19*a* and the steel core center opening 16. The cap 18 has, as a lower portion, a thin flat disk 24 having an undersurface that fits over and extends beyond the outer edge of the steel core 15, as shown best in FIG. 3. The steel core 15 whereto is mounted the cap 18 is suspended in the outer sleeve 14 by a section of rubber 22 so as to leave a void 23 between the undersurface of the steel core 15 and above a lower edge 14*b* of the outer sleeve 14. So arranged, when a force is applied to the cap 18, that force is transmitted into the steel core 15 that is supported by the section of rubber 22 that functions as a disk spring, allowing the cap and steel core to move downwardly into the void 23 above the lower edge 14*b* of the outer sleeve 14. With the removal of which force, the section of rubber 22 rebounds, moving the steel core and cap back to their original attitude.

The cap 18, as shown in FIGS. 3, 4A, 4B and 4C, includes the thin flat disk shaped undersurface 18*a* that fits onto and extends across a top surface of the steel core 15 and projects into the section of rubber 22 top surface 22*a*. The cap 18, shown best in FIGS. 2 and 3, includes spaced radial ribs 25 that are mounted onto the disk 24 top surface that each slope upwardly from a junction 25*a* with the disk 24 edge to a short cylindrical cap neck 26 that the center hole 19 is formed through.

So arranged, as shown in FIGS. 1 and 2, the cap 18 can be divided along an axis bisecting its top surface into two hemispheres 30 and 31, respectively, that can be colored differently. For example, with the cap dividing line aligned with the outside lane stipe, as shown in FIG. 1, the inner hemisphere 30 can be coated with a reflective material, and the outer surface 31 can be colored red. Which reflective surface 30, when exposed to a vehicle headlights will reflect, warning a driver of the presence of the highway marker 10 on the lane line. With, as during day light, the red surface 31 provides a visual warning to a driver of danger, such as driving the wrong direction in the lane.

Hereinabove has been set out a description of a preferred embodiment of the highway marker of the invention. It should however, be understood that the present invention can be varied within the scope of this disclosure without departing from the subject matter coming within the scope of the following claims, and a reasonable equivalency thereof, which claims I regard as my invention.

I claim:

1. A highway marker comprising, a cylinder formed from a rigid material; a rigid cylindrical core having a threaded center opening therethrough and having a length that is less than the length of said rigid cylinder and a diameter that is less than the interior diameter of said cylinder to be spaced apart from said cylinder so as to be movable up and down therein; a disk shaped cap for mounting onto a top of said rigid core, extending beyond the side of said core and is spaced apart from the inner circumference of said rigid cylinder, and which said cap has a raised center collar wherefrom sloping ribs extend at equal spaced radials to the cap edge, with said ribs sloping from the top of said collar to said cap edge, and said collar includes a center hole for receiving a bolt fitted therethrough for turning is said rigid core threaded center opening; and a section of resilient rubber that is bonded on it's opposite ends to the opposing outer surface of said rigid core and the inner surface of said rigid cylinder, filling the spaced between said rigid core outer surface and said rigid cylinder inner circumference, leaving a void between the bottom of said rigid core and the lower edge of said rigid cylinder that said rigid core is suspended in at an end of said resilient rubber, allowing said rigid core to move downwardly by a downwardly directed force, stretching said resilient rubber that then rebounds, lifting said rigid core out of said void, when said downwardly directed force is removed.

2. The highway marker as recited in claim 1, wherein the rigid cylinder is formed from a section of five inch steel pipe; and the rigid core is formed from a smooth wall steel cylinder.

3. The highway marker as recited in claim 2, wherein the resilient rubber is in liquid form and is poured into the space between the smooth wall steel core and the steel cylinder interior to, when dried, permanently bonds to the opposing surfaces of said steel core smooth wall and steel cylinder.

4. The highway marker as recited in claim 1, wherein the cap top surface is divided into hemispheres across the collar center opening, and each hemisphere is colored differently from the other.

5. The highway marker as recited in claim 4, where the one cap hemisphere is coated with a reflective material and the other cap hemisphere is coated with a color to convey information or warning.

* * * * *